United States Patent [19]

Cole

[11] 4,126,778

[45] Nov. 21, 1978

[54] COOKING-STOVE STRUCTURE

[76] Inventor: Edward D. Cole, Emery Star Rte., Huntington, Utah 84528

[21] Appl. No.: 808,139

[22] Filed: Jun. 20, 1977

[51] Int. Cl.[2] ..... H05B 3/68

[52] U.S. Cl. ..... 219/461; 126/21 R; 126/214 D; 219/463

[58] Field of Search ..... 219/458, 459, 460, 461, 219/462, 463; 126/21 R, 214 D, 215, 274; 99/447

[56] References Cited

U.S. PATENT DOCUMENTS

| | | | |
|---|---|---|---|
| 1,154,411 | 9/1915 | Kuhn et al. | 219/461 |
| 1,855,507 | 4/1932 | Bathrick | 219/461 |
| 1,922,420 | 8/1933 | Coulston | 126/214 D X |
| 2,070,498 | 2/1937 | Tournier | 219/461 |
| 2,111,369 | 3/1938 | Marvin et al. | 126/214 D X |
| 2,633,524 | 3/1953 | Smith | 219/463 |
| 2,751,487 | 6/1956 | Vallorami et al. | 219/463 |
| 2,856,503 | 10/1958 | More | 219/461 X |
| 3,065,327 | 11/1962 | Coultrip | 219/461 X |

FOREIGN PATENT DOCUMENTS

| | | | |
|---|---|---|---|
| 196,981 | 4/1958 | Austria | 219/461 |
| 834,488 | 5/1960 | United Kingdom | 219/461 |

*Primary Examiner*—Volodymyr Y. Mayewsky
*Attorney, Agent, or Firm*—M. Ralph Shaffer

[57] ABSTRACT

Improvements in cooking stoves or ranges, whether of the gas or electric variety, which advantageously recaptures and directs heat to the underside of the cooking vessel and at the same time permits restricted air circulation to allow for air-conduction of excess heat from the bowl, beneath the stove heating element, to prevent such bowl from overheating.

10 Claims, 6 Drawing Figures

COOKING-STOVE STRUCTURE

FIELD OF INVENTION

The present invention relates to heating stoves, whether electrically or gas operated, the structure providing for a maximum presence of heat proximate the under-surface of the vessel being heated while at the same time permitting ventilation from the stove bowl beneath such vessel. In particular, a reflector is disposed above the central aperture of the stove bowl and is designed to reflect radiant energy upwardly to the under-surface of the vessel being supported and/or heated by the heating element of the stove. The reflector is positioned to allow for air circulation through the central ventilating aperture of the stove bowl leading to peripheral area surrounding the burner or heating element. A heat shield peripherally surrounds the burner, is disposed essentially horizontally, and allows for a concentration of heat proximate the annular margin of the under-surface of such vessel being heated while at the same time permitting ventilation from the central bowl aperture to annular areas surrounding the heat shield supplied.

DESCRIPTION OF THE PRIOR ART

Electric and gas ranges which are used for heating cooking vessels at their undersides are, of course, in common use in households and other establishments, and include range-top heating elements or burners which are suitably supported by appropriate structure; underneath the burners are located individual burner, stove bowls. These bowls are conventionally made of sheet metal, are formed to be concave upwardly, and will include a bottom or base central aperture which provides for (1) finger tip insertion, accommodating bowl removal for cleaning purposes, and also (2) air ventilation through the bowl stove area to carry away excess heat upwardly and essentially above the periphery of the heating element being used. The stove bowl is thus customarily removable and may be easily cleaned, capturing any drippings or spills from the heating vessel used or otherwise proximate the periphery thereof. The invention thus pertains to the essentially conventional stove tops, and not to the newly-designed flush cooking surfaces having imbedded heating elements.

Both electric and gas energy sources are becoming extremely expensive, progressively so, and a conventional burner or heating element installation are inefficient since much of the radiant heat of the electric heating elements, for example, escapes through the central aperture supplied in the stove bowl. Additionally, air convection currents are very pronounced and conduct heat very rapidly from the interior of the bowl to the upper and outer areas of the bowl, well beyond the heating vessel under-surface.

What is desired, and that which is supplied in the present invention, is a reflection of light and heat energy by suitable reflector means positioned over the central aperture of the stove bowl, so that such heat as would otherwise escape through such aperture will be returned proximate the burner or heating element; another provision supplied herein is a certain heat shield for concentrating upwardly rising heat energy onto the under-surface of the cooking vessel and particularly along the peripheral margin thereof, thereby metering or regulating the air convection ascending from the central aperture of the stove stove bowl and proceeding through the space between such stove bowl and the shield used.

No art is known teaching the employment of a central reflector, disposed above the central aperture of the stove bowl, nor the concept of a heat shield for focusing or restraining heat to the under-surface of the cooking vessel while at the same time permitting only a very modest amount of heat to escape past the peripheral underside edge of any large cooking vessel being used.

DESCRIPTION OF THE PRESENT INVENTION

According to the invention the heating elements, whether they be gas burners or electrical heating elements, are installed on stove or range tops with such structure as will optimize heat transfer and heat presence proximate the horizontal plane at which the heating vessel such as a pot or pan is being supported. Where an electrical heating element is used, the vessel to be heated is customarily supported directing by such heating element, the latter resting upon rigid radial structure supported by other parts of the stove top. In the case of the gas burner the same will be positioned beneath some suitable support grating or some other structure designed to support the heating vessels. In both cases, within the context of the present invention, bowls or bowl elements will be used beneath the heating elements or burners. There will be concaved upwardly and incorporate the usual base central aperture. In the present invention a highly polished reflector is mounted above said central aperture, preferably with legs locking into or being supported by the rim surrounding such central aperture. This reflector member serves to return radiant heat energy, in fact all heat in the red and infrared region, back to and above the burner area for heating the vessel disposed thereabove. Such central aperture as is supplied in the stove bowl is not closed, however, but admits of finger insertion, when the bowl is to be removed for cleaning purposes, and also provides for air convection currents to carry excess stove bowl heat upwardly proximate the outer margin or peripheral area of the burner or heating element used. The second addition, in the form of an annular shield, is employed to concentrate heat stemming from such rising, air-convection currents onto the peripheral margin of the vessel used while preventing air-convection currents in immediate proximity with the outer turns of the respective heating elements but permitting air-convection escape of heat within the bowl only proximate a small annular region immediately interior of the bowl at the upper mouth thereof, remote from the outer turn of the heater element. In this matter the heat generated is utilized essentially to its maximum, and material energy savings will result.

OBJECTS

Accordingly, a principal object with the present investion is to provide a new and improved heating structure for warming or heating cooking vessels.

A further object is to provide in an electric stove or range, or indeed a stove operating on gas use fuel, certain structure related to the customary burner or heating-element stove bowls, wherein air convection properties are maintained, but with simply a reduced escape of heat.

A further object is to provide a stove design, and particularly for the heating element bowl thereof, a reflector which is disposed above the customarily-supplied central aperture at the base of such stove bowl.

An additional object is to provide a heat shield which reduces the escape of heat by air convection and also serves to concentrate heat rising proximate the peripheral margin of the cooking vessel to actually be directed upon such margin, thereby serving, in combination with the heating element or means to maximize heat transfer to such cooking vessel.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

BRIEF DESCRIPTION OF PREFERRED EMBODIMENTS

Figure 1:
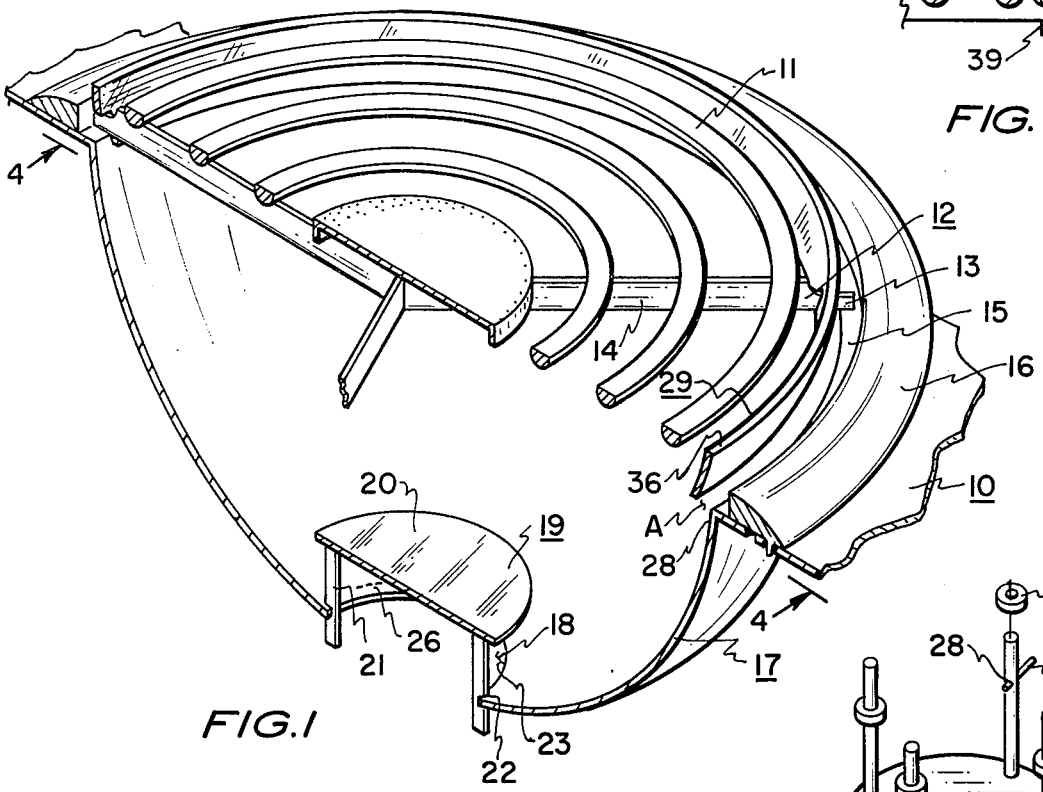
FIG. 1 is an enlarged fragmentary perspective of the heating element and stove bowl of a cooking range being supplied the reflector member and shield for improving heating efficiency on such stove area.
Figure 2:
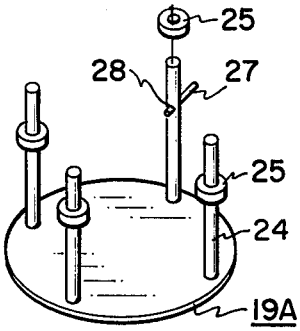
FIG. 2 is a perspective view of the reflector member utilized, when inverted.

In FIG. 1 the stove 10 includes the customary electric heating element or burner 11 which is shown in section and is connected to an electric power circuit in the usual manner. The heating element as indicated is strictly conventional. Such heating element 11 is supported on rigid radial structure 12, the tips 13 of the radial ribs 14 thereof resting upon stove structure 15, which is conventional. There may be supplied the usual decorative ring 16 that outlines the upper region of stove bowl 17. Stove bowl 17 supplies the usual base central aperture 18 which is for the purpose of supplying both convection air currents, to provide the escape of an excess buildup of heat in the stove bowl and also to admit of the convenient removable of the stove bowl for cleaning purposes. The invention herein supplies a reflector member 19 taking the form of reflector element 20 supported by legs 21. The legs 21 may be notched at 22 and be resilient so as to provide the slective engagement of such notches with peripheral edge 23 defining central aperture 18. Alternatively, see FIG. 2, the reflector member 19A, corresponding to reflector member 19 in FIG. 1, may be provided with a pin-type legs 24 having circular abutments 25 which are secured, welded or soldered to legs 24 in position as indicated in FIG. 2. These abutments will serve as reaction supports for the reflector member and will engage the peripheral margin 26 of the stove bowl surrounding aperture 23. Further, as another alternative, pin means in the form of pins 27 may be secured in apertures 28 to provide the abutment means needed so as to position the reflector element 20 to a position not only over but upwardly spaced from central aperture 18. This reflector element 20 is preferably chrome-plated and highly polished so as to cause a reflection of heat energy from the upper surface of the reflector element 20 upwardly to the burner or heating element area, so that such heat is not allowed to escape through central aperture 18. It is noted, however, that since the reflector element 20 is spaced above the base aperture 18 of the stove bowl, the same will not prevent slight air currents to carry, by convection, the heat proximate the stove bowl area upwardly and outwardly to the circular marginal area immediately within the upper mouth or lip 28 of the stove bowl.

Figure 4:
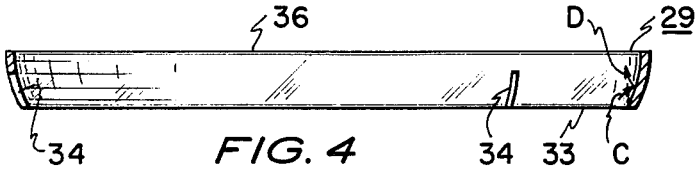
FIG. 4 is a transverse cross-section taken along the line 4—4 in FIG. 1, of the annular heat shield ring used in FIG. 1 and shown therein in fragmentary detail.
Figure 5:
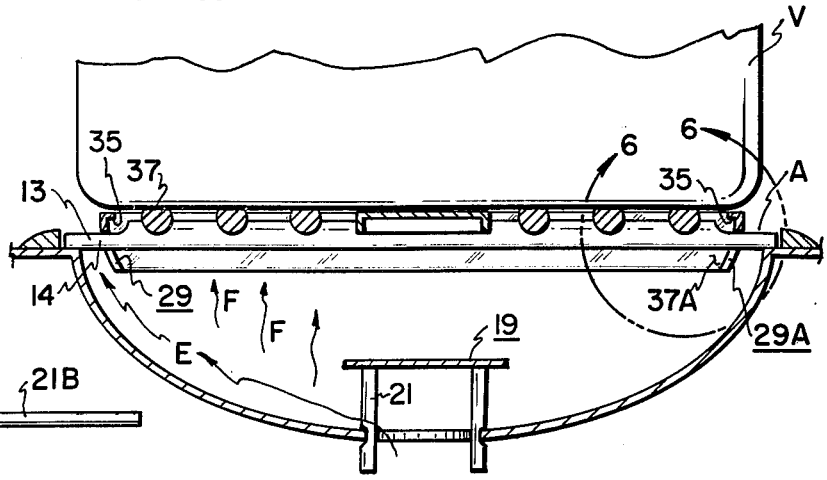
FIG. 5 is similar to FIG. 4 but illustrates the annular heat shield or ring therein as being installed in the burner structure of FIG. 1.

An annular heat shield 29 is supplied, is best seen in FIGS. 4 and 5 and will now be described.

Figure 3:
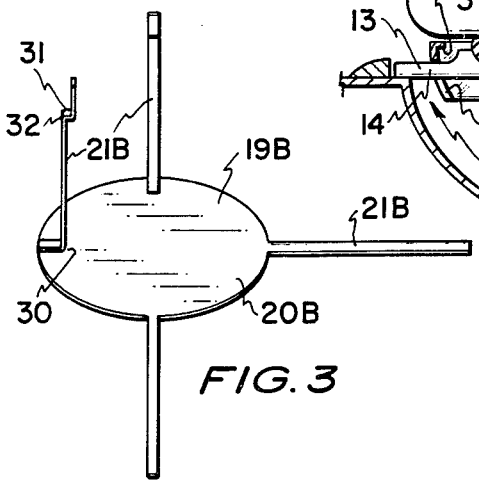
FIG. 3 is similar to FIG. 2 but illustrates an alternate reflector which is stamped as having integral legs to be formed or bent appropriately.

Preliminary thereto, it is to be noted that a reflector means 19B seen FIG. 3, which corresponds as an alternative embodiment to reflector member 19 in FIG. 1, this time is a stamped part having a reflector portion 20B and legs 21B which are stamped and formed in the matter as shown at 21B1 in FIG. 3. The remaining legs are shown in the flat; however, it will be understood that these are likewise formed in the manner shown relative to the remaining two legs. Such legs may include, in addition to the first bend 30, a second bend 31 to provide for a support region 32, relative to each leg, such that the reflector member may be maintained in the position C in FIG. 1 relative to the counterpart reflector member 19.

Figure 6:
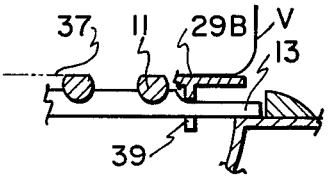
FIG. 6 is an enlarged view of an area, taken along the line 6—6 in FIG. 5, illustrating a structure slightly modified relative to FIG. 5, wherein the heat shield or ring member takes a horizontal, flat form.

In returning to the FIGS. 1, 4 and 6 it is noted that the annular heat shield 29 simply comprises an annular ring element 33 provided with notches 34 for receiving the outer extremities 13 of the radial ribs 14 as seen in FIG. 1. The ring element is preferably curved and canted as shown, approximately 25° relative to vertical, in the sectional configuration in FIG. 4, so that heat proceeding upwardly in the direction of the arrows C, for example, see FIG. 4, will be reflected from such surface and proceed in the direction D upwardly to the vessel being heated. If it is desired, an annular lip may be included as an optional lip feature as shown at 35 in FIG. 4, to further direct the heat upwardly. In this regard, the annular heat shield 29A in FIG. 5 represents the slight modification of the annular heat shield 29 in FIG. 4. It is noted in any event that the upper edge 36 of the heat shield is preferably disposed as proximately in line with the plane 37 defined by the upper surfaces of the burner coil or windings. Annular area A is still available for permitting convection currents to carry excess heat away from the bowl area to the exterior, thereby precluding the overheating of the bowl. Notwithstanding the same, a substantial amount of heat found within the bowl area is reflected by the reflector element 20 of reflector member 19, see FIG. 1, and also is directed to the under-surface of the cooking vessel by means of the inner surface 37A of annular heat shield 29 or 29A, as the case may be, see heat arrows F and air-current arrows E in FIG. 5.

As a separate consideration, an annular heat shield 29B has notched support legs 39 resting on portions 13, and may be disposed in the flat for actually adding heat to the peripheral margin, of the under-surfaces of large cooking vessels, as well as precluding excessive air convection currents escaping to the exterior of the cooking vessel about its underside annular edge. In such event the heat shield 29B in FIG. 6 should be surfaced a dark color as by anodizing or selection of materials, so that the heat shield element at this time absorbs heat, conveys the same to the vessel being heated, but restricts air-convection currents as to flow past the heating vessel.

It is to be noticed that both the reflector member 19 and the heat shield as at 29 are easily removed for cleaning purposes. Yet these measureably increase the efficiency at each burner area of the stove.

In operation, energy is reflected upwardly from reflector element 19 in FIG. 1, for example, to add to the heat energy present at the heater coil 11 of the stove. Air circulation still proceeds upwardly through central aperture 18. Such air-flow is restricted through peripheral area A in FIG. 1, thus not sweeping in proximity past the outer turn of the heating element, so as to reduce the latter's heat-effectiveness, but rather ensuring that a majority of the rising heat energy is constrained to impinge upon the bottom surface of the cooking vessel Y, see FIG. 5.

For one particular embodiment of the invention, with the following range-top electric heaters (Western Citation 1972 range):

| | Thickness of Coil | Perimeter Area | Radius |
|---|---|---|---|
| Small coil heating element or burner | 0.1875" | .022 ft.$^2$ | 2.75" |
| Large coil heating element or burner | 0.1875" | .031 ft.$^2$ | 3.75" |

the following results were calculated, using the principles enumerated in "Principles of Heat Transfer", by Frank Kreith, 2d ed., and based on reflector 2.5" dia., spaced one-half inch above bowl aperture of 1.75" dia., heat shield 6" dia. (small burner) and 8" dia. (large burner), both 1" wide:

| Calculation of Heat Saved | | | |
|---|---|---|---|
| Small Burner | | Large Burner | |
| Temperature Settings | | Temperature Settings | |
| 400° F | 10.6 BTU/hr | 400° F | 14.9 BTU/hr |
| 600° F | 19.8 BTU/hr | 600° F | 27.9 BTU/hr |
| 800° F | 30.1 BTU/hr | 800° F | 42.4 BTU/hr |
| 1000° F | 31.6 BTU/hr | 1000° F | 58.6 BTU/hr |

Accordingly, appreciable heat energy savings and improved efficiency results when the features of the present invention are utilized.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. In a cooking stove having a horizontal range top having a burner aperture and provided with an energizable, horizontally disposed electrical heating element aligned with said aperture, supporting means supported by said range top for supporting said electrical heating element, an upwardly concave, single bowl, for said heating element, supported by said range top and extending beneath said electrical heating element, said bowl having a central base aperture: an improvement comprising reflecting means disposed between said aperture and said heating element, and support means, free from but positionably engaging said bowl at said central base aperture, for so supporting said reflecting means.

2. The combination of claim 1 where in said reflecting means comprises a reflector member, said support means comprising upstanding support leg structure depending from said reflector member and engaging said bowl proximate said aperture.

3. The combination of claim 1 wherein said reflector means and said support means are cooperatively constructed to provide air flow generally upwardly through said aperture along the interior of said bowl.

4. The combination of claim 1 wherein said reflecting means comprises a horizontal planar disk having a chrome-finished, reflective upper surface.

5. The combination of claim 2 wherein said leg structure comprises plural leg members extending into said aperture and having support abutments engaging said bowl proximate said aperture.

6. In a cooking stove having a range top provided with an aperture and an energizable, horizontally disposed electrical heating element aligned with said aperture and having an outer periphery, an upwardly concave bowl having a central base aperture and supported by said range top and extending beneath said electrical heating element, and support means for supporting said electrical heating element: an improvement comprising a horizontal heat reflector supported for disposition between said heating element and bowl and above said central base aperture thereof; an annular heat shield disposed about the periphery of said electrical heating element and inwardly spaced from said bowl, whereby to provide an annular air passageway between said bowl and said annular heat shield for air rising from said central base aperture, said annular heat shield being constructed to direct rising heat energy inwardly of the outer periphery thereof; and support means including radially extending ribs supportively engaging said annular heat shield for so supporting said annular heat shield.

7. The structure of claim 6 wherein said annular heat shield is nominally ring-shaped, having an upwardly-and-outwardly sloping vertical, transverse, elemental cross-section.

8. The structure of claim 6 wherein said annular heat shield comprises a heat-transfer element of nominally horizontally flat, ring-shaped confringement.

9. For a cooking stove having a horizontal range top provided with an aperture, a stove burner installation including, in combination, an electrical heating element aligned with said aperture, means for supporting said heating element in a horizontal disposition, an upwardly concave bowl disposed beneath said heating element, said bowl having a base central aperture, reflector means disposed above and supportively engaging said bowl and also positioned over and spaced from said base central aperture, heat shield means for confining a predominance of heat energy therewithin for upward application, while directing substantial air flow exterior thereof within said bowl, and means for so supporting said heat shield means, and concave bowl comprising structure for directing some air-flow arising from said base central aperture toward and past the exterior of said heat shield means.

10. In combination, and for a cooking stove, a range top having a burner aperture, an apertured bowl aligned with and positioned beneath said burner aperture, an electrical heating element aligned with said burner aperture and disposed above said apertured bowl, structural means for supporting a heating element, said structural means including plural radial ribs in supporting contact with said heating element, and horizontal, ring-like heat shield means essentially horizontally surrounding said heating element, spaced interior of said burner aperture, and provided with notches supportively receiving said radial ribs.

* * * * *